US006058195A

United States Patent [19]

Klippel

[11] Patent Number: 6,058,195

[45] Date of Patent: May 2, 2000

[54] ADAPTIVE CONTROLLER FOR ACTUATOR SYSTEMS

[76] Inventor: Wolfgang J. Klippel, Tauscher Str. 10, D-01277 Dresden, Germany

[21] Appl. No.: 09/050,459

[22] Filed: Mar. 30, 1998

[51] Int. Cl.[7] ..... H04R 25/00

[52] U.S. Cl. ..... 381/96; 381/150; 381/59

[58] Field of Search ..... 381/55, 56, 58, 381/59, 96, 97, 107, 108, 150

[56] References Cited

U.S. PATENT DOCUMENTS 5,528,695 6/1996 Klippel ..... 381/55

5,894,522 4/1999 Brown ..... 381/94.8

*Primary Examiner*—Curtis A. Kuntz

*Assistant Examiner*—Suhan Ni

*Attorney, Agent, or Firm*—Koppel & Jacobs

[57] ABSTRACT

The invention relates to an arrangement for converting an electric input signal into an acoustic or a mechanical output signal comprising a transducer 19, a controller 15 and a parameter detector 17. The output 23 of the controller is connected via the parameter detector to the terminals of the transducer. The controller has a parameter vector input 24 to change the linear or nonlinear transfer characteristic of the controller between its control input 13 and control output 23. The parameter detector comprises an error circuit 31 and update circuit 33. The error circuit 31 measures an electric signal at the terminals of the transducer and generates an error signal e(t) which describes the difference between the measured electric signal and an estimated electric signal derived from the output signal or other state signals of the controller. The update circuit 33 estimates transducer parameters by minimizing the amplitude of the error signal. The estimated parameters are supplied both to the error circuit 31 and to the controller 15 to adjust the controller to the particular transducer and to compensate for distortion in the mechanical or acoustic output signal.

29 Claims, 7 Drawing Sheets

ADAPTIVE CONTROLLER FOR ACTUATOR SYSTEMS

BACKGROUND OF THE INVENTION

1. Field of the Invention

The invention relates generally to an arrangement and a method for adaptively controlling a transducer to compensate for linear and/or nonlinear signal distortion generated by the transducer and to realize a desired overall transfer characteristic between the electric input signal and the output signal.

2. Description of the Related Art

Transducers used as actuators (loudspeakers, headphones, shakers) produce substantial linear and nonlinear distortion in the output produced by the actuator. This distortion affects the quality of the sound reproduction or impairs the efficiency of active sound attenuation systems. An electric controller connected to the input terminals of the transducer can compensate for signal distortion if the controller utilizes the inverse transfer characteristic of the transducer. Compensation for inherent nonlinearities of the transducer requires a nonlinear controller, which can be realized, e.g., by using a polynomial filter as disclosed in U.S. Pat. No. 4,709,391, or a mirror filter as disclosed in U.S. Pat. No. 5,438,625, or with static state feedback linearization as described by J. Suykens et. al, "Feedback Linearization of Nonlinear Distortion in Electrodynamic Loudspeakers," J. Audio Eng. Soc., vol. 43 (1995), pp. 690–694.

In order to cope with parameter uncertainties, the adjustment of the free parameters of the controller can be performed adaptively, as disclosed in the German patent application DE 4332804 A1. This arrangement allows the filter parameters to be determined in the normal operating mode reproducing an audio or other signals, without off-line pre-training, and adapting on-line for parameter changes caused by heating and aging. However, an adaptive controller requires information about the output signal or internal states of the transducer. The direct measurement of an acoustic or a mechanical output signal requires a precise sensor (e.g., microphone, accelerometer) which is expensive and impractical in many applications.

The German patent DE 4334040 discloses an adaptive control system which dispenses with an additional acoustic or mechanical sensor. An adaptive detector circuit estimates the velocity of the voice-coil by using the electric voltage and the current measured at the terminals of the transducer. The estimated velocity is supplied to an adaptive control filter and is used for the estimation of optimal filter parameters. The adaptive adjustment of the filter and the adaptive adjustment of the detector are two separate processes, which can be realized with different filter architectures. However, two separate adaptive systems cause high computational complexity which can not be implemented on available digital signal processors at low costs.

OBJECTS OF THE INVENTION

There is thus a need for an adaptive control system for transducers to compensate for linear and nonlinear signal distortion generated by the transducer, to protect the transducer against thermal and mechanical overload and to produce a desired transfer characteristic between control input and transducer output in the overall system.

A second object is to adjust the free parameters of the controller to the particular transducer by measuring an electric signal (voltage or current) at the loudspeaker's terminals and thus to eliminate the need for an expensive sensor.

Another object is to provide an adaptive control system which has a minimum of unknown parameters and which guarantees stable and robust convergence.

A further object is to realize an adaptive control system for transducers comprising a minimum of elements and requiring a minimum of processing capacity in a digital signal processor (DSP) to keep the cost of the system low.

SUMMARY OF THE INVENTION

A system is presented for converting an electric input signal into a mechanical or an acoustic output signal, which includes a transducer, a controller and a parameter detector. The controller has a control input which is supplied with the electric input signal and generates a control output which is supplied to a signal input of the parameter detector. The parameter detector has two signal outputs which are connected with the terminals of the transducer.

The controller compensates for linear and nonlinear distortions generated by the transducer and/or protects the transducer against mechanical or thermal overload and permanent destruction. In order to increase the efficiency of the transducer at large excursions, the controller adjusts the rest position of the voice coil to the minimum of its k(x) characteristic or to the maximum of its force factor characteristic by adding a position control signal to the electric control signal.

The parameter detector has a parameter vector output comprising one or more estimates of transducer parameters. The controller has a parameter vector input which receives the parameter vector output of the detector. The controller has a variable transfer characteristic between its control input and control output depending on the instantaneous values of the parameter vector input.

The free parameters of the controller are adjusted to the particular transducer to produce a desired transfer characteristic in the overall system between control input and transducer output. Both the controller and the parameter detector are based on a physical model of the transducer. Thus, the optimal parameters of the controller can be directly derived from the transducer parameters. In a first step, the parameter detector identifies this model and estimates the transducer parameters by measuring an electric signal at the transducer terminals. In a second step, the identified transducer parameters are supplied to the parameter vector input of the controller and the optimal control parameters are derived from the estimated transducer parameters by using a defined relationship between transducer parameters and control parameters. Finally, the variable transfer characteristic of the controller is adjusted by using the optimal control parameters. The systems known in the prior art require an adaptive circuit in the controller to estimate the optimal control parameters separately. The present invention reduces the computational complexity and improves the speed and robustness of the parameter estimation.

DETAILED DESCRIPTION OF THE INVENTION

Figure 1:
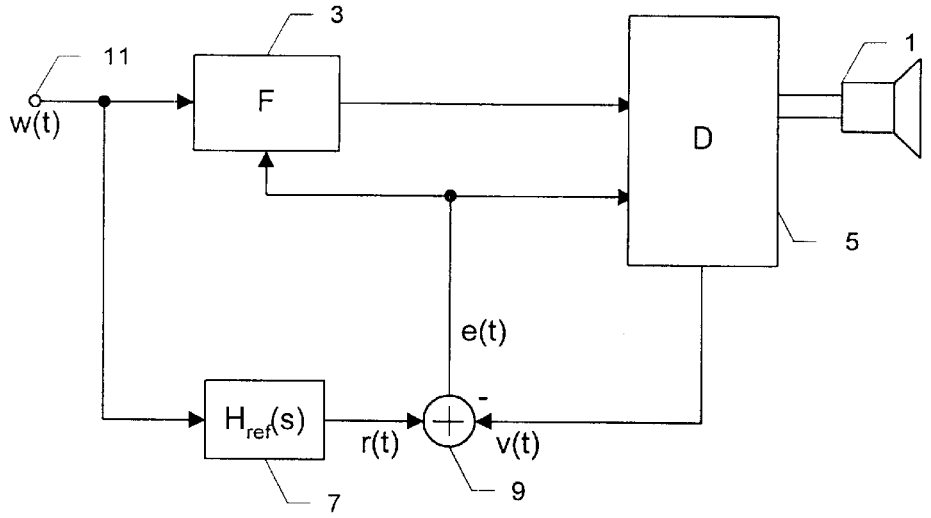
Fig. 1 (PRIOR ART)
FIG. 1 is a general block diagram of an adaptive controller known in the prior art.

FIG. 1 shows the general block diagram of an adaptive controller for transducers disclosed in the German patent DE 4334040. The arrangement comprises a transducer 1, an adaptive correction filter 3, an adaptive detector circuit 5, a reference filter 7 and a comparer 9. An electric signal w(t) at a signal input 11 is supplied via the correction filter 3 and via the following detector circuit 5 to the terminals of the transducer 1. The detector circuit 5 generates an estimate of the velocity v(t) of the voice-coil of the coupled transducer 1. Both a reference signal r(t) generated by the reference filter 7 and the estimated velocity v(t) are supplied to the comparer 9, which produces an error signal e(t)=r(t)−v(t). Both the correction filter 3 and the detector circuit 5 are adaptive systems performing a separate parameter estimation based on minimization of the error signal e(t).

Figure 2:
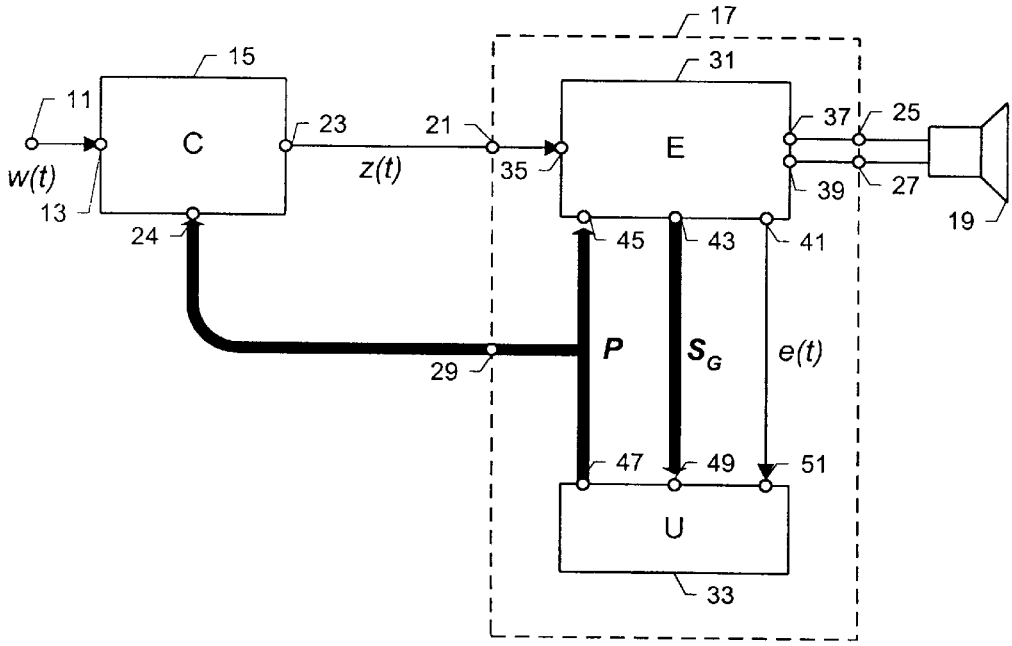
FIG. 2 shows an embodiment of an adaptive controller for actuators in accordance with the present invention.

FIG. 2 shows a first embodiment of an adaptive control system for actuators in accordance with the present invention. The arrangement comprises a controller 15, a parameter detector 17 and a transducer 19.

The controller has a variable transfer characteristic between a control input 13 and a control output 23, which depends on the instantaneous transducer parameters summarized in a vector P received at a parameter vector input 24. In contrast to the prior art shown in FIG. 1, controller 15 is not an adaptive filter provided with an error signal; rather, controller 15 has a variable linear or nonlinear transfer characteristic defined by the parameter vector input 24.

The parameter detector 17 has a detector input 21, two detector outputs 25 and 27 and a parameter vector output 29. The detector input 21 is provided with the signal z(t) from control output 23. The detector outputs 25 and 27 are connected with the terminals of the transducer 19. The transducer parameters P are estimated by the parameter detector and are supplied via the parameter vector output 29 to the parameter vector input 24 of controller 15.

The parameter detector 17 comprises an error circuit 31 and an update circuit 33. The error circuit 31 has an error circuit input 35, two error circuit outputs 37 and 39, an error output 41, a gradient output 43 and a parameter vector input 45. The error circuit input 35 is provided with the signal z(t) at detector input 21. The error circuit outputs 37 and 39 are connected with the detector outputs 25 and 27, respectively. The parameter vector input 45 is provided with estimates on the transducer parameters P. The error circuit 31 generates an error signal e(t) at error output 41 which is a criterion of the identification of the transducer parameters. The error circuit 31 also generates a gradient vector $S_G$ which is derived from estimated state signals of the transducer.

The update circuit 33 has a parameter vector output 47, a gradient vector input 49 for receiving gradient vector $S_G$ and an error input 51 for receiving the signal from error output 41. The update circuit 33 generates estimates on the transducer parameters P depending on the gradient signal $S_G$ and the error signal e(t). The estimated parameters are supplied via parameter vector output 47 to the parameter vector input 45 and to the parameter vector output 29. The parameter detector 17 is optimally adjusted to the particular transducer and the parameter vector P is the best estimate of the real transducer parameters when the amplitude of the error signal e(t) is at a minimum.

Figure 3:
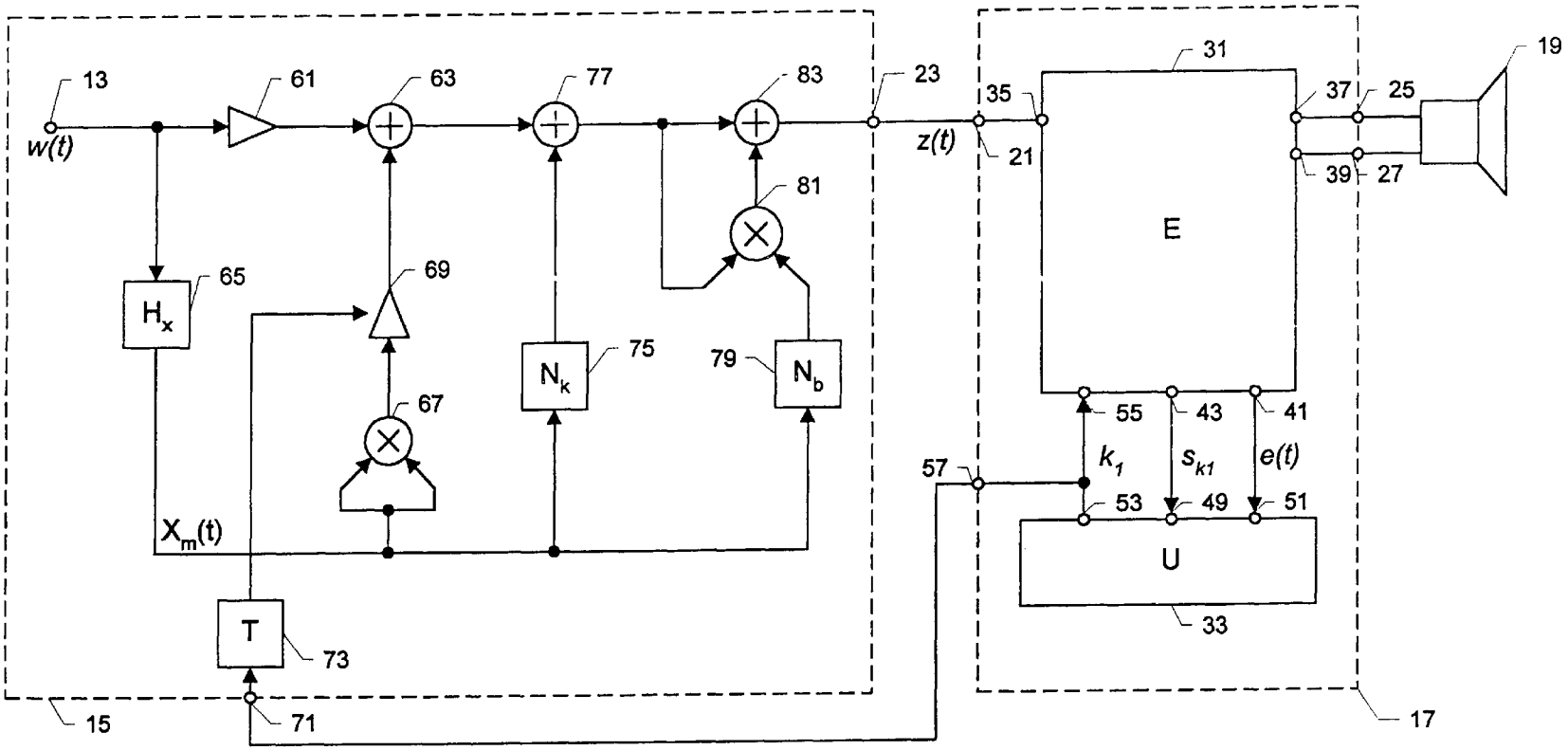
FIG. 3 shows an embodiment of the controller of FIG. 2 in greater detail.

The controller 15 can be realized by using a linear or nonlinear filter or static state feedback linearization technique to reduce the signal distortions and/or to attenuate the signal w(t) under overload conditions. FIG. 3 shows an embodiment of the controller in greater detail. Using mirror filter technology for current drive, the controller output z(t) is generated according to the control equation:

$$i = z = \frac{1}{b(x_m)}[b(0)w + (k(x_m) - k(0))x_m] \tag{1}$$

where the displacement $$x_m = L^{-1}\left[\frac{b(0)}{ms^2 + R_m s + k(0)}\right] * w \tag{2}$$

is synthesized from the input w, b(x) is a varying force factor dependent on the displacement x, k(x) is the varying stiffness of the mechanical suspension, m is the moving mass, $R_m$ is the mechanical damping, s the Laplace operator and $L^{-1}\{\ \}$ is the inverse Laplace transformation.

The nonlinear parameters are expanded into a truncated power series as follows:

$$b(x)=b_0+b_1x+b_2x^2$$
$$L_e(x)=l_0+l_1x+l_2x^2$$
$$k(x)=k_0+k_1x+k_2x^2 \tag{3}$$

The linear parameters m, $R_m$ and the coefficients in Eq. (3) are the free parameters of the controller, which are directly related with the transducer parameters summarized in vector P. The transfer response of the controller is made adjustable by using an amplifier with controllable gain for each of the control parameters. For clarity reasons, FIG. 3 shows only the adjustment of the control parameter $k_1$, but the other control parameters are made adjustable in the same way. The electric signal w(t) at the control input 13 is supplied via an amplifier 61 having a gain $b_0$ to a first input of an adder 63. The input 13 is also connected to the input of a linear filter 65 which generates the displacement $x_m$ according to Eq. (2). The displacement $x_m$ is supplied via a squarer 67 and a following controllable amplifier 69 to the other input of adder 63. This branch performs the compensation for second-order distortion caused by displacement stiffness k(x).

A parameter estimate $k_1$ at an input 71 which is part of the parameter vector input 24 in FIG. 2 is supplied via a parameter transformer 73 to a control input of the controllable amplifier 69. The parameter transformer 73 converts the transducer parameter into a corresponding control parameter depending on the desired overall characteristic. In order to linearize the overall system, the gain of controllable amplifier 69 has to be equal to the transducer parameter $k_1$. The parameter transformer 73 also checks the value of the estimated transducer parameter with respect to physical plausibility, and stores the estimated parameter to keep the controller operative if the parameter detector is partly disabled.

A static nonlinear system 75 and an adder 77 perform the compensation for higher-order distortion caused by nonlinear stiffness k(x). The compensation for the nonlinear force factor b(x) is accomplished according to Eq. (1) by using a static nonlinear system 79, multiplier 81 and an adder 83. FIG. 3 also shows the transfer of the transducer parameter $k_1$, which is part of the parameter vector P from an update output 53 of update circuit 33 to both a parameter input 55 of the error circuit 31 and via an output 57 to the parameter input 71.

Figure 4:
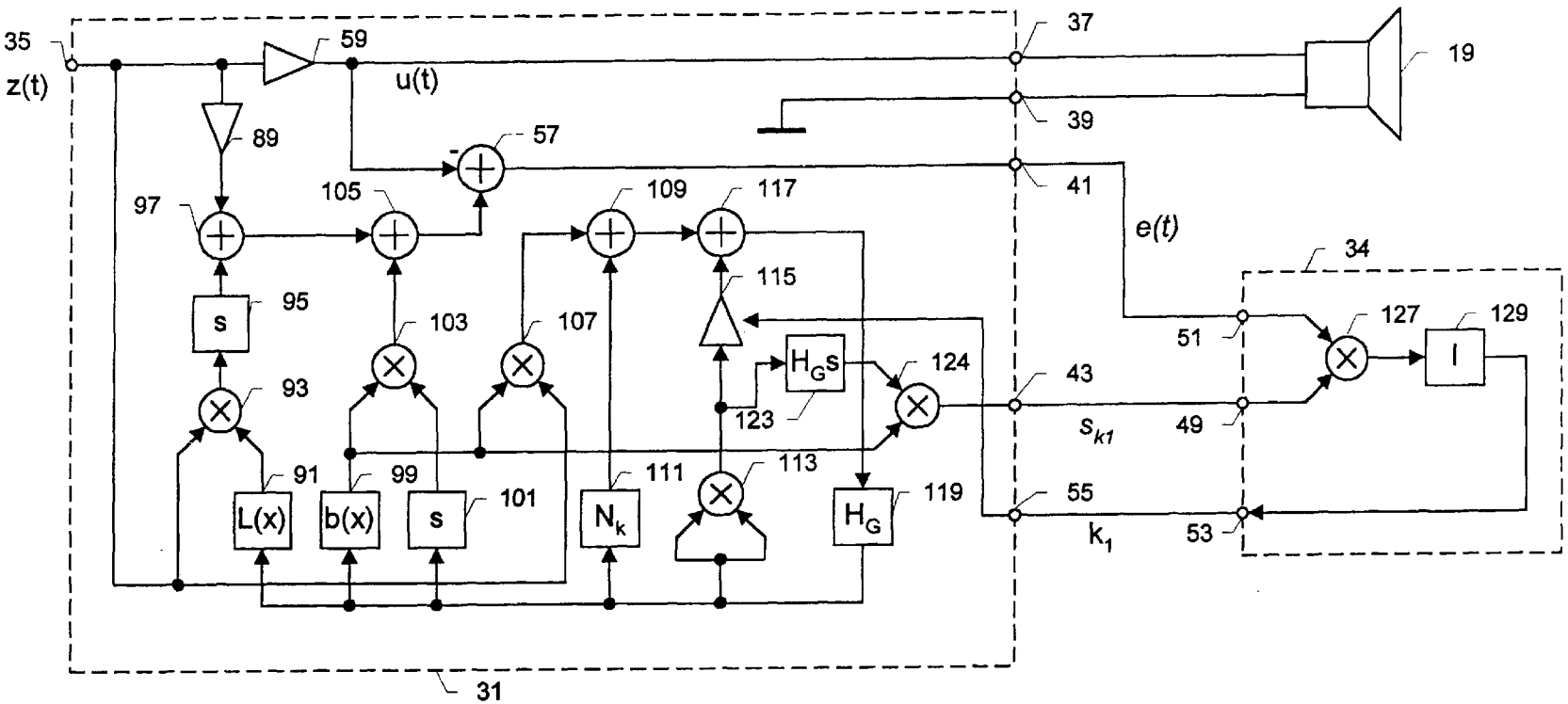
FIG. 4 shows an embodiment of the error circuit and the update circuit for the controller of FIG. 2 in greater detail.

FIG. 4 shows an embodiment of error circuit 31 and update circuit 33 in greater detail. The control output signal z(t) is supplied via the error circuit input 35 to an amplifier 59 having a high output impedance. This amplifier converts the control signal z(t) into a current i(t), which is supplied to the transducer (current drive). The voltage u(t) between the transducer terminals corresponds with the instantaneous impedance of the transducer.

The error circuit 31 contains a comparer 57 having a first input which receives the voltage u(t) measured at the transducer terminals, a second input provided with an estimated voltage û(t), and an output which produces the error signal e(t)=û(t)−u(t) supplied to the error output 41.

The error circuit 31 estimates the voltage û(t) as follows:

$$\hat{u} = R_e i + L_e(x_D)\frac{di}{dt} + b(x_D)\frac{dx_D}{dt} \tag{4}$$

The estimated displacement $X_D$ is given by:

$$x_D = (ib(x_D) - (k(x_D) - k(0))x_D) * L^{-1}\left[\frac{1}{ms^2 + R_m s + k(0)}\right] \tag{5}$$

where $R_e$ is the voice-coil resistance and $L_e(x)$ is the varying inductance of the voice-coil. This part of the error circuit has a variable transfer characteristic between current i(t)=z(t) and the estimated voltage û(t) depending on the transducer parameters summarized in vector P. For clarity reasons, FIG. 4 shows only the adjustment of the nonlinear coefficient $k_1$ but the same principle is also applied to the other parameters in P. In accordance with Eq. (4), the error circuit 31 includes an amplifier 89 having a gain $R_e$, a static nonlinear system 91 having a transfer function $L_e(x)$, a multiplier 93, a differentiator 95, an adder 97, a static nonlinear system 99 having a transfer function b(x), a differentiator 101, a multiplier 103 and an adder 105. The estimated voltage û(t) at the output of adder 105 is supplied to the comparer 57. In accordance with Eq. (5), the displacement $x_D$ is estimated by using a multiplier 107, an adder 109, a static nonlinear system 111, a squarer 113, a controllable amplifier 115, an adder 117, and a linear filter 119 having a transfer function $H_G(s)$, given by $H_G(s)=1/(ms^2+R_m s+k(0))$.

The controllable amplifier 115 has a control input provided with a parameter estimate $k_1$ from parameter input 55, which is part of the parameter vector input 45 in FIG. 2. The output of the squarer 113 is also supplied to an input of a linear filter 123 having a transfer function $H_G(s)s$. A multiplier 124 multiplies the output of the filter 123 with the output of the static nonlinear system 99 and generates the gradient signal $s_{k1}$ supplied to the output 55 which is part of the gradient vector output 43 in FIG. 2.

The update circuit 33 looks for a minimum of the mean squared error:

$$\text{MSFE}=E[e(t)^2]=E[(\hat{u}(t)-u(t))^2]=J(P) \tag{6}$$

which depends on the transducer parameters P.

Beginning with an initial estimate of the transducer parameters P, the next guess of the parameter vector is determined by the simple recursive relation:

$$\begin{aligned} P(i+1) &= P(i) + \frac{1}{2}\mu\left[\frac{\partial J}{\partial P}\right] \\ &= P(i) + \mu E\left[e(t)\frac{\partial \hat{u}(t)}{\partial P}\right] \\ &= P(i) + \mu E\left[e(t)S_G\right] \end{aligned} \tag{7}$$

leading to a straightforward gradient-based adaptation algorithm. In accordance with Eq. (7), an update circuit 34, which is a part of the update circuit 33 in FIG. 2, performs the adjustment of parameter $k_1$ and comprises a multiplier 127 and an integrator 129. The multiplier 127 is provided with the error signal e(t) and the gradient signal $s_{k1}=\partial\hat{u}(t)/\partial k_1$ via the gradient signal input 49. According to the straightforward LMS algorithm, the expectation operator E[ ] is approximated by the integrator 129, which supplies the parameter estimate $k_1$to the parameter output 53. If the amplitude of the error is at a minimum, the detector is optimally adjusted to the particular transducer and provides optimal estimates on the transducer parameter $k_1$(part of vector P) and state signal (displacement $X_D$) of the transducer.

Figure 5:
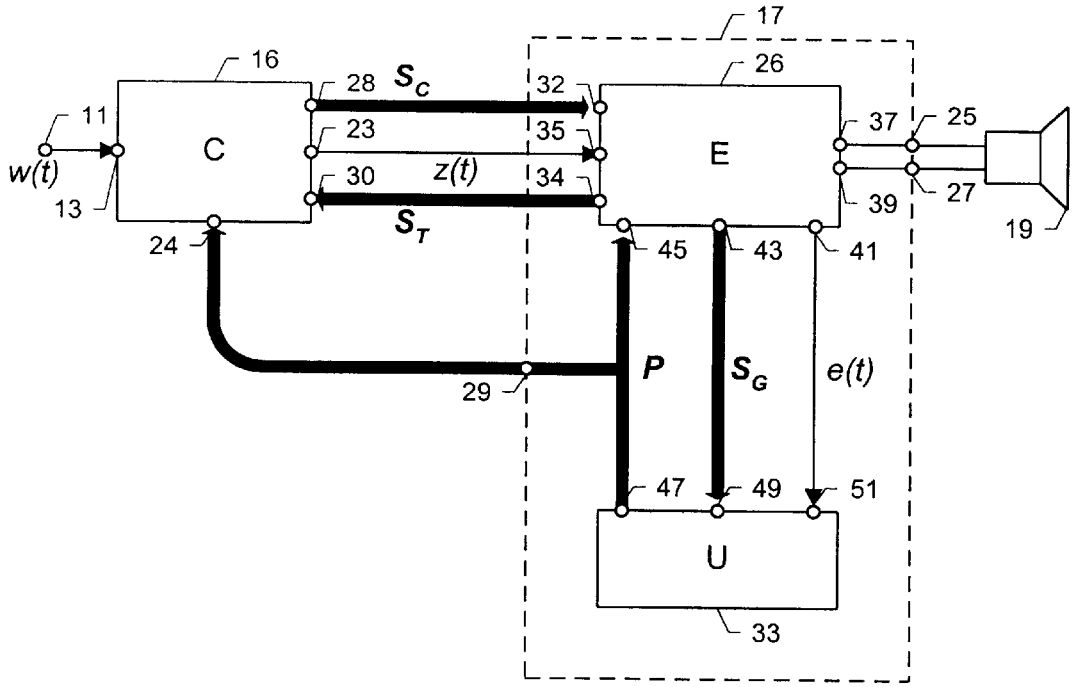
FIG. 5 shows second embodiment of an adaptive controller in accordance with the present invention.

FIG. 5 shows a second embodiment of the invention. The controller 16 corresponds with the controller 15 in FIG. 2, but has an additional control state vector output 28 and a transducer state vector input 30. The error circuit 26 corresponds with the error circuit 31 in FIG. 2, but has an additional control state vector input 32 that is connected with the control state vector output 28, and a transducer state vector output 34 connected to the detector state vector input 30. The transfer of the state vector $S_c$ of the controller into the error circuit 26 allows a modification of the parameter estimation. Substituting the current in Eqs. (4) and (5) by Eq. (1) and calculating the partial derivation of Eq. (7) with respect to the common transducer parameters P leads to gradient vector $S_G$, which depends on the states of the detector 17 and the states of the controller 16. The gradient vector $S_G$ is supplied to the gradient vector input 49 of the update circuit 33. To insure the stability and convergence of the parameter estimation, the present invention uses a joint parameter update system instead of two separate update systems as disclosed in prior art.

Using regular state feedback linearization, the controller 16 has a transducer state vector input 30 which receives the estimated transducer states $S_T$ (e.g., displacement $x_D$) from the transducer state vector output 34. The control equation of controller 16 corresponds with the control equation Eq. (1) of the mirror filter, but instead of using the synthesized displacement $x_m$, uses the displacement $x_D$ estimated in accordance with Eq. (5) by the error circuit.

Figure 6:
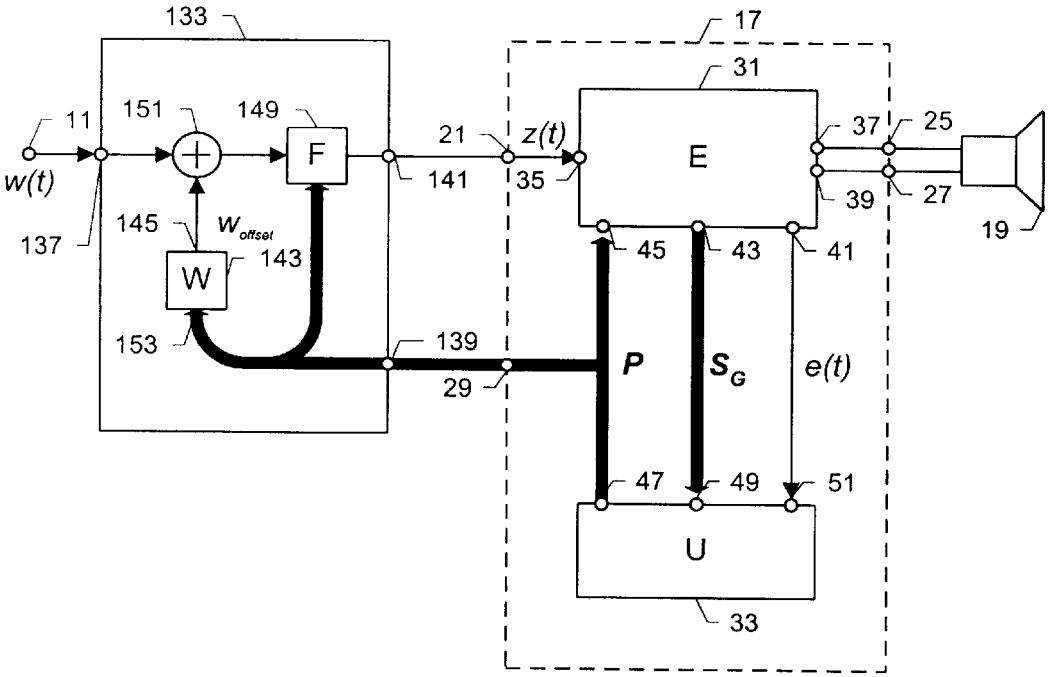
FIG. 6 shows a third embodiment of an adaptive controller in accordance with the present invention, performing a correction of voice-coil position.

FIG. 6 shows a third embodiment of the invention. This arrangement corrects the position of the voice coil of the transducer by adding a dc signal $w_{offset}$ to the electric input signal w(t). This dc component $w_{offset}$ moves the rest position of the voice-coil to the minimum of the stiffness characteristic k(x) or to the maximum of the force factor characteristic b(x). This reduces the nonlinear distortion caused by asymmetric parameter characteristics and improves the stability and the efficiency of the overall system. The controller 133 comprises an adder 151, a nonlinear control circuit 149 and a position control circuit 143. The first input of the adder 151 is provided with the electric control signal w(t) via a control input 137. The second input of the adder is provided with the signal $w_{offset}$ from an output 145 of position control circuit 143. The output of adder 151 is supplied via the nonlinear control circuit 149 to the control output 141. An input 153 of position control circuit 143 and an input of control circuit 149 receive transducer parameter vector P via input 139. To move the rest position of the voice coil into the minimum of the k(x) characteristic, the position control circuit generates the signal $w_{offset}$ as follows:

$$w_{offset} = -\frac{k_1}{2k_2} L^{-1}\left[\frac{ms^2 + R_m s + k(0)}{b(0)}\right] \tag{8}$$

Figure 7:
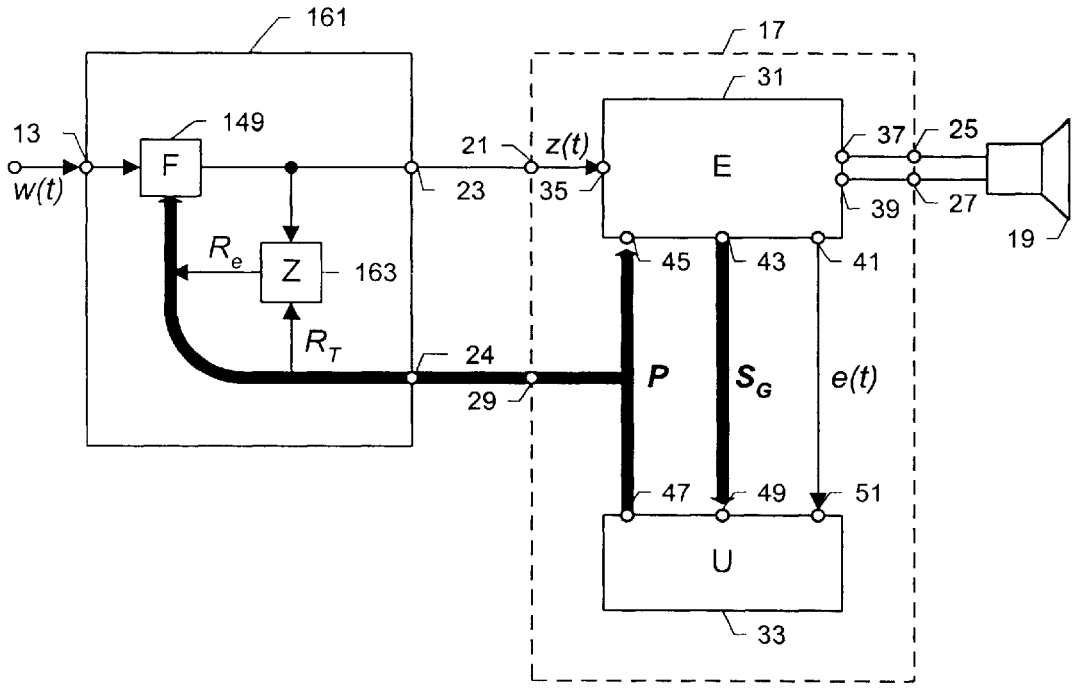
FIG. 7 shows a fourth embodiment of an adaptive controller in accordance with the present invention which compensates for thermal power compression.

FIG. 7 shows a fourth embodiment of the invention, in which the transducer is driven by a low impedance source (normal voltage drive). Here the transfer characteristic of the controller depends on the instantaneous electric resistance $R_e(t)$ of the voice coil and requires a permanent updating of this parameter when the temperature of the voice coil varies. Alternatively, the electric resistance $R_e(t)$ can be calculated by a resistance estimator 163 within a controller 161 provided with the electric signal from the control input 13 or control output 23 and the thermal resistance $R_T$ estimated by the parameter detector 17 and supplied via the parameter input 24.

Figure 8:
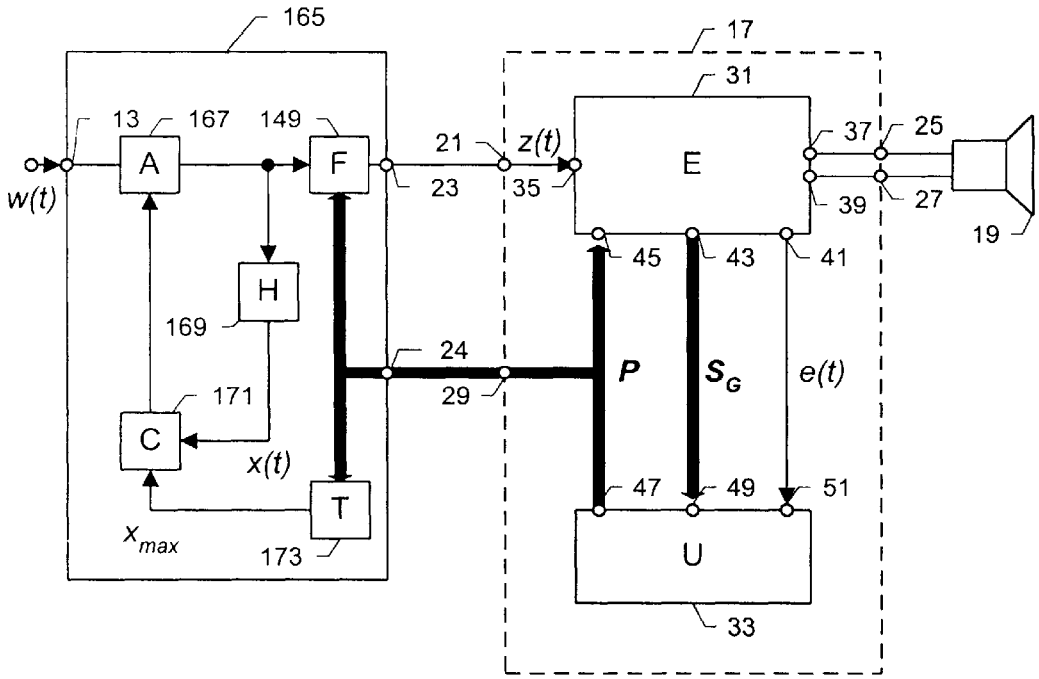
FIG. 8 shows a fifth embodiment of an adaptive controller in accordance with the present invention providing overload protection.

FIG. 8 shows a fifth embodiment of the invention. The controller 165 comprises a control filter 149 for linearizing the transducer and means for protecting the transducer against mechanical destruction. The signal w from the control input 13 is provided via an attenuating device 167 to the input of the control filter 149 and to the input of a reference filter 169 which estimates the instantaneous displacement x of the voice coil. If the absolute value of the displacement $|x(t)|$ equals the critical threshold $x_{max}$, a controller 171 activates the attenuating device 167 which attenuates the input signal. According to the invention, the threshold $x_{max}$ is calculated by a threshold detector 173 using the nonlinear parameters (force factor and stiffness) provided with the parameter vector P from the parameter vector input 24.

The above description shall not be construed as limiting the ways in which this invention may be practiced but shall be inclusive of many other variations that do not depart from the broad interest and intent of the invention.

I claim:

1. An adaptive controller for converting an electric input signal into a mechanical or an acoustic output signal using a transducer, comprising:

a controller having a control input connected to receive said electric input signal, a control output generating an electric output signal, and a parameter vector input for receiving one or more transducer parameter values; and a parameter detector having a detector input, two detector outputs and a parameter vector output, wherein said detector input is connected to receive said control output, said detector outputs are connected to the terminals of said transducer and said parameter vector output comprises one or more of said transducer parameter values supplied to said parameter vector input of said controller;

said adaptive controller arranged to adaptively compensate for signal distortion caused by said transducer and for realizing a desired transfer characteristic between said electric input signal and said mechanical or acoustic output signal.

2. The adaptive controller of claim 1, wherein said one or more transducer parameter values are estimates of corresponding parameters associated with said transducer.

3. The adaptive controller of claim 1, wherein said controller has a variable transfer characteristic between said control input and said control output that varies in accordance with the values of said one or more transducer parameter values received at said parameter vector input.

4. The adaptive controller of claim 1, wherein said controller includes a control system which receives said control input, generates said control output and has at least one control parameter input connected to receive a control parameter.

5. The adaptive controller of claim 4, wherein said control system is a linear control system.

6. The adaptive controller of claim 4, wherein said control system is a non-linear control system.

7. The adaptive controller of claim 4, wherein said control system includes at least one parameter transformer having a transformer input connected to receive one of said transducer parameters from said parameter vector input and having a transformer output connected to said control parameter input.

8. The adaptive controller of claim 7, wherein said parameter transformer is arranged to transform said transducer parameter into said control parameter and thereby produce said desired transfer characteristic in the overall system.

9. The adaptive controller of claim 7, wherein said parameter transformer is arranged to transform said transducer parameter into said control parameter and thereby protect the transducer against a mechanical or thermal overload.

10. The adaptive controller of claim 7, wherein said parameter transformer includes a memory for generating a control parameter at said transformer output if said transducer parameter is not available at the transformer input.

11. The adaptive controller of claim 7, wherein said parameter transformer is arranged to set said control parameter to a predetermined value if said transducer parameter is not within a defined range.

12. The adaptive controller of claim 1, wherein said parameter detector is an adaptive system.

13. The adaptive controller of claim 12, wherein said parameter detector comprises:

an error circuit having an error circuit input connected to said detector input, error circuit outputs connected to said detector outputs, a transducer parameter vector input for receiving one or more transducer parameters, a gradient vector output for producing one or more gradient signals, and an error output for producing an error signal; and an update circuit having a gradient vector input connected to receive said gradient vector output, an error input connected to receive said error output and producing a transducer parameter vector output comprising estimates of one or more transducer parameters, said transducer parameter vector output supplied to said parameter vector output and to said transducer parameter vector input, said update circuit arranged to produce said transducer parameter estimates by minimizing the amplitude of said error signal.

14. The adaptive controller of claim 13, wherein said error circuit comprises:

a monitoring circuit having a monitor input connected to receive said error circuit input, two monitor outputs supplied to said error circuit outputs and a measuring output, said monitoring circuit arranged to measure the voltage at said terminals of said transducer and to produce said measured voltage at said measuring output;

an estimating circuit having an estimator input, an estimator parameter vector input connected to receive said transducer parameter vector input, an estimator gradient vector output connected to said gradient vector output, and an estimator output, said estimating circuit having a variable transfer characteristic between said estimator input and said estimator output which varies with the transducer parameter vector input received at said estimator parameter vector input; and a comparer having a first input connected to receive said estimator output and a second input connected to receive said measuring output and a comparer output connected to said error output and arranged to produce the difference of the signals at said first and second comparer inputs.

15. The adaptive controller of claim 14, wherein said detector input is connected to said estimator input via said error circuit input.

16. The adaptive controller of claim 1, wherein said controller produces a control vector state output comprising one or more state signals of said controller and said parameter detector has a control vector state input connected to receive said control vector state output.

17. The adaptive controller of claim 1, wherein said parameter detector further includes a transducer state vector output which comprises one or more estimates of state signals of said transducer and said controller has a transducer state vector input connected to receive said transducer state vector output.

18. The adaptive controller of claim 1, wherein said controller further comprises:

a position control circuit having an input connected to receive said parameter vector input and having an position control output; and an adder having a first adder input connected to receive said electric input signal via said control input, a second adder input connected to receive said position control input and an adder output connected to said control output.

19. The adaptive controller of claim 1, wherein said controller further comprises:

a position control circuit having an input connected to receive said parameter vector input and having an position control output; and an adder having a first adder input connected to receive said electric input signal via said control input, a second adder input connected to receive said position control input and an adder output connected to said control output via a nonlinear control circuit.

20. The adaptive controller of claim 4, wherein said controller further comprises a resistance estimator having an estimator signal input, at least one thermal parameter input connected to receive one of said transducer parameters from said parameter vector input, and an output supplied to said control parameter input, said output producing an estimate of the electrical resistance of said transducer's voice coil.

21. The adaptive controller of claim 20, wherein said estimator signal input is connected to receive said controller's electric input signal.

22. The adaptive controller of claim 20, wherein said estimator signal input is connected to receive said controller's electric output signal.

23. A method of converting an electric input signal into a mechanical or an acoustic output signal, comprising the steps of:

transforming said electric input signal into an electric control signal using a mapping function which can be altered by control parameters;

converting said electric control signal into a mechanical or acoustic output signal using a transducer;

measuring a second electric signal different from said electric control signal at the terminals of said transducer;

modeling said transducer using a transducer model having free model parameters;

estimating optimal model parameters for said transducer model to describe the relationship between said electric control signal and said second electric signal;

transforming said optimal model parameters into optimal control parameters using the relationship between the transducer model and the mapping function to produce a desired overall function between said electric input signal and said mechanical or acoustic output signal; and adjusting said mapping function using said optimal control parameters.

24. The method of claim 23, wherein said modeling of said transducer is based on a nonlinear transducer model having linear and nonlinear parameters, and said transforming of said electric input signal into said electric control signal is based on a mapping function which is nonlinear.

25. The method of claim 23, further comprising the steps of:

storing the optimal model parameters if the step of estimating said optimal model parameters for said transducer model is intermittently performed; and using said stored parameters in the mapping function which transforms said electric input signal into an electric control signal.

26. The method of claim 23, further comprising the steps of:

storing the optimal control parameters if the step of estimating said optimal model parameters for said transducer model is intermittently performed; and using said stored parameters in the mapping function which transforms said electric input signal into an electric control signal.

27. The method of claim 23, further comprising the steps of:

generating a position control signal from said optimal model parameters; and moving the voice coil to an optimal rest position using said position control signal.

28. The method of claim 23, further comprising the steps of:

estimating a state signal of the transducer using a signal which indicates the thermal or mechanical overload of the transducer by using said electric input signal;

calculating a threshold value from the optimal model parameters which describes the allowed maximum amplitude of said state signal; and changing the mapping function to attenuate said control signal if the amplitude of said state signal exceeds said threshold value.

29. The method of claim 23, further comprising the steps of:

estimating a state signal of the transducer using a signal which indicates the thermal or mechanical overload of the transducer by using said electric output signal;

calculating a threshold value from the optimal model parameters which describes the allowed maximum amplitude of said state signal; and changing the mapping function to attenuate said control signal if the amplitude of said state signal exceeds said threshold value.

* * * * *

UNITED STATES PATENT AND TRADEMARK OFFICE

CERTIFICATE OF CORRECTION

PATENT NO. : 6,058,195
APPLICATION NO. : 09/050459
DATED : May 2, 2000
INVENTOR(S) : Wolfgang J. Klippel It is certified that error appears in the above-identified patent and that said Letters Patent is hereby corrected as shown below:

On the title page item 30, the following Foreign Application Priority Data should be inserted below the filing date, as follows:

-- Foreign Application Priority Data
July 4, 1997 (DE) ..... 197 14 199.4-31 --

Signed and Sealed this
Twenty-second Day of March, 2016

Michelle K. Lee

Michelle K. Lee
*Director of the United States Patent and Trademark Office*